US007052276B2

(12) United States Patent
Davidsson et al.

(10) Patent No.: US 7,052,276 B2
(45) Date of Patent: May 30, 2006

(54) SYSTEM AND METHOD FOR COMBAT SIMULATION

(75) Inventors: Stefan Davidsson, Ulricehamn (SE); Ulf Björkman, Jönköping (SE); Ingemar Emricson, Bankeryd (SE); Peter Hermansson, Huskvarna (SE); Åke Jansson, Jönköping (SE); Per Klahr, Tidaholm (SE)

(73) Assignee: SAAB AB, Linkoping (SE)

( * ) Notice: Subject to any disclaimer, the term of this patent is extended or adjusted under 35 U.S.C. 154(b) by 109 days.

(21) Appl. No.: 10/250,970

(22) PCT Filed: Jan. 3, 2002

(86) PCT No.: PCT/SE02/00008

§ 371 (c)(1),
(2), (4) Date: Dec. 31, 2003

(87) PCT Pub. No.: WO02/055951

PCT Pub. Date: Jul. 18, 2002

(65) Prior Publication Data

US 2004/0096806 A1 May 20, 2004

(30) Foreign Application Priority Data

Jan. 10, 2001 (SE) ..... 0100067

(51) Int. Cl.
*F41A 33/00* (2006.01)

(52) U.S. Cl. ..... 434/11; 434/14; 434/16; 434/21; 463/2

(58) Field of Classification Search ..... 434/11–27, 434/365; 463/2, 5, 50; 273/358, 371, 372; 348/121, 141
See application file for complete search history.

(56) References Cited

U.S. PATENT DOCUMENTS

| | | | | | |
|---|---|---|---|---|---|
| 4,478,581 | A | * | 10/1984 | Goda | 434/22 |
| 4,682,953 | A | | 7/1987 | Doerfel et al. | |
| 5,292,254 | A | * | 3/1994 | Miller et al. | 434/11 |
| 5,474,452 | A | | 12/1995 | Campagnuolo | |
| 5,481,979 | A | | 1/1996 | Walder | |
| 5,695,341 | A | * | 12/1997 | FitzGerald et al. | 434/16 |
| 5,788,500 | A | * | 8/1998 | Gerber | 434/22 |
| 6,050,822 | A | * | 4/2000 | Faughn | 434/11 |
| 6,139,323 | A | * | 10/2000 | Christians et al. | 434/16 |
| 6,174,169 | B1 | * | 1/2001 | Gerber | 434/11 |
| 6,251,011 | B1 | * | 6/2001 | Yamazaki | 463/2 |
| 6,283,756 | B1 | * | 9/2001 | Danckwerth et al. | 434/11 |

(Continued)

FOREIGN PATENT DOCUMENTS

| | | |
|---|---|---|
| WO | 99/30103 | 6/1999 |
| WO | 99/39148 | 8/1999 |

*Primary Examiner*—Joe H. Cheng
(74) *Attorney, Agent, or Firm*—Swidler Berlin LLP

(57) ABSTRACT

The invention relates to simulation of effects in a combat environment, wherein personnel, vehicles and buildings are exposed to simulated fire from military weapons. Direct fire and indirect fire are simulated by means of at least one of light rays and radio waves. Effects of attacking fire are registered by means of a target object device, which includes sensors adapted to detect the light rays respective the radio waves and are co-located with the target object (140). According to the invention the target object is associated to at least one protecting object located between the simulated fire and the target object if such object exists in the current combat situation. This enables a consideration to various protecting object— influence on the simulated fire and the effects on corresponding actual fire. The invention thereby simulates the effects of direct fire and indirect fire in a realistic manner, which in turn provides good chances of an adequate behavior of the training personnel in a corresponding live situation.

30 Claims, 5 Drawing Sheets

U.S. PATENT DOCUMENTS 6,386,879 B1 * 5/2002 Varshneya et al. ..... 434/16
6,561,809 B1 * 5/2003 Lynch et al. ..... 434/16
6,579,097 B1 * 6/2003 Sampson et al. ..... 434/21
6,669,477 B1 * 12/2003 Hulet ..... 434/14
6,755,653 B1 * 6/2004 Varshneya ..... 434/22
2002/0064760 A1 * 5/2002 Lazecki et al. ..... 434/11
2003/0152892 A1 * 8/2003 Huang et al. ..... 434/11

* cited by examiner

SYSTEM AND METHOD FOR COMBAT SIMULATION

THE BACKGROUND OF THE INVENTION AND PRIOR ART

The present invention relates generally to simulation of a combat environment, wherein personnel, vehicles and buildings are exposed to military weapons. More particularly the invention relates to a method for simulating effects of direct fire and indirect fire against a target object wherein simulated fire is represented by at least one of light rays and radio waves and the effect of the simulated fire is registered by at least one of a light sensor and a radio receiver being co-located with the target object, a target object device for registering effects at a target object caused by simulated direct fire and simulated indirect fire, a protecting object device for automatic association of at least one target object to a protecting object and modification of effects caused by simulated direct fire and simulated indirect fire at the target object, wherein simulated fire is represented by at least one of light rays and radio waves, and a combat simulating system for simulating effects of direct fire and indirect fire against target objects, wherein simulated fire is represented by at least one of light rays and radio waves and the effect of the fire is registered by at least one of a light sensor being co-located with respective target object and a radio receiver being co-located with respective target object. The invention also relates to a computer program and a computer readable medium for performing the steps of the method for simulating effects of direct fire and indirect fire.

It is well known to simulate effects of fire attacks and other firing weapons, in the form of for instance mines, when training military personnel. Direct fire, which primarily is intended to have effect against a specific point is usually simulated by means of optical equipment, whereby laser light commonly represents the fire and optical sensors are used to register hits. Indirect fire, whose nature is area covering is usually simulated by means of radio waves, which are transmitted from some kind of transmitter antenna, for instance at the simulated weapon and whose effect is registered via one or more receiver antennae in proximity to potential targets.

The American patent document U.S. Pat. No. 4,682,953 describes a system for simulating the efficiency of indirect fire support on a battlefield. Control signals are transmitted over a target area based on choice of ammunition. Radio waves of different types are transmitted in response to the control signals, which are intended to imitate the effect of the specific ammunition. The radio waves indicate, via indicator units within the target area, which point targets that could have been hit of the chosen ammunition if it actually had been fired against the target area. The document also describes various means to geographically define the fire's area of efficiency relative the targets' positions.

A development of this system is disclosed in the American patent document U.S. Pat. No. 5,474,452. Here the efficiency of indirect fire is simulated by transmission of acoustic or radio frequent signals of a first frequency to selected geographical positions. A respective sensor at each of these positions activates equipment that in turn generates a multidirectional acoustic signal of a second frequency, which represents a simulated explosion with an epicenter at the sound source. Acoustic sensors at the respective target determine, according to predetermined rules, whether a particular target has been hit, has almost been hit or has been missed completely by the explosion. The result is presented immediately by means of acoustic alarms and visual indicators associated with each respective target.

The patent document U.S. Pat. No. 5,292,254 discloses a method for simulating the effects of a mine field in a battlefield. Sensors placed on soldiers and vehicles indicate their geographical positions to a central computer. The central computer determine whether a particular soldier or vehicle respectively is located within the activation radius of a mine in the simulated mine field. If it is decided that the activation requirement is fulfilled with respect to a mine, an explosion of the mine in question is simulated, possible damages caused by the same are registered and the mine is thereafter regarded as inactive by the central computer.

The international patent application WO99/39148 describes a method for simulating the effects of hand grenade fire and mines for participants in a military exercise. Data is exchanged via a two-way radio link between the simulated weapon and sensors at the potential targets with the aim of determining the effect of a particular hand grenade and mine respectively within an area and its surroundings.

The patent U.S. Pat. No. 5,481,979 discloses a hand grenade dummy, where the corresponding live weapon's effect is simulated by means of a multitude of infrared light diodes. Light sensors at potential targets register the effect of the hand grenade. Different explosive force/range of the grenade can be simulated through a variation of the light diodes' lighting power.

The hitherto known solutions constitute examples of fire simulations, which all show defects in the capability of imitating the effects of corresponding actual fire in a realistic manner. This is true both with respect to direct and indirect fire. Some of the known solutions give the impression that the fire has a higher efficiency/range than what is realistic, while others fail to fully reveal the fire's actual efficiency/range. However, a feature common to all solutions is that they provide a more or less false picture of the fire's consequences.

SUMMARY OF THE INVENTION

The object of the present invention is therefore to alleviate the problem above and thus provide a solution, which more realistically simulates the effect of direct fire and indirect fire against different kinds of target object. Particularly, the invention aims at modeling the influence of objects being located between the fire and the target against which the fire is directed.

According to one aspect of the invention this object is achieved by a method for simulating effects of direct fire and indirect fire against a target object as described initially, which is characterized by automatic association of the target object to at least one protecting object. Such an association is accomplished when the target object is located at a position relative the protecting object, such that the protecting object influences at least one of the effect of direct fire, the effect of indirect fire, reception of the light rays and reception of the radio waves. In both the former cases the modification thus means that it is taken into account that the protecting object influences the simulated fire in a different way than the corresponding actual fire. The association is maintained via a local co-operation between means adapted for this purpose in the target object and the at least one protecting object respectively. In both the latter cases however, the modification involves consideration of the fact that the protecting object influences actual fire in a different way than corresponding simulations of such fire.

By indirect fire is here understood any weapon effect against an area. It should also be noted that direct fire may be simulated by means of light rays as well as radio waves, either in the alternative or in combination. Correspondingly, indirect fire may either be simulated by means of light rays, radio waves or a combination thereof. Simulated fire may be accomplished in two fundamentally different ways. Either at least one simulation transmitter is mounted on a live weapon or the simulated fire is generated completely synthetically via a virtual weapon, for example by transmitting a radio message from a radio mast, whose position does not have to be correlated with the simulated firing position.

According to another aspect of the invention the object is achieved by a computer program directly loadable into the internal memory of a digital computer, comprising software for controlling the method described in the above paragraph when said program is run on a computer.

According to yet another aspect of the invention the object is achieved by a computer readable medium, having a program recorded thereon, where the program is to make a computer perform the method described in the penultimate paragraph above.

According to still another aspect of the invention the object is achieved by the target object device described initially, which is characterized in that the device includes a first association means for automatically associating the target object to at least one protecting object when the target object is located at a position relative the protecting object, such that the protecting object influences at least one of the effect of direct fire, the effect of indirect fire, reception of the light rays and reception of the radio waves. Moreover, the device includes means for locally maintaining the association to the at least one protecting object. The latter means is adapted to co-operate with corresponding means in the at least one protecting object.

According to yet another aspect of the invention the object is achieved by a protecting object device for automatic association of at least one target object to a protecting object and modification of effects caused by simulated direct fire and simulated indirect fire at the target object. It is here presumed that the simulated fire is represented by light rays and/or radio waves. The protecting object device includes a second association means for automatically associating a target object to a protecting object in response to an association signal from the target object. The second association means in turn includes means for locally maintaining the association to the at least one associated target object. Furthermore, the second association means is adapted to co-operate with corresponding means in the at least one associated target object. Additionally, the protecting object device includes a modifying means for modifying the effects of the simulated fire against target objects, which are associated to the protecting object. This modification is performed with respect to the protecting object's capability to protect against corresponding actual fire relative the protecting object's influence on the simulated fire.

According to still another aspect of the invention the object is achieved by the combat simulating system for simulating effects of direct fire and indirect fire against target objects as described initially, which is characterized in that it includes at least one target object that is assigned a proposed target object device and at least one proposed protecting object.

The proposed solution enhances the realism of a simulated combat environment. The training personnel can thereby effectively be stimulated to an adequate behavior in a corresponding live situation. Naturally, this improves the personnel's chances of a successful action-taking in future live combat situations.

BRIEF DESCRIPTION OF THE DRAWINGS

The present invention is now to be explained more closely by means of preferred embodiments, which are disclosed as examples, and with reference to the attached drawings.

DESCRIPTION OF PREFERRED EMBODIMENTS OF THE INVENTION

Figure 1:
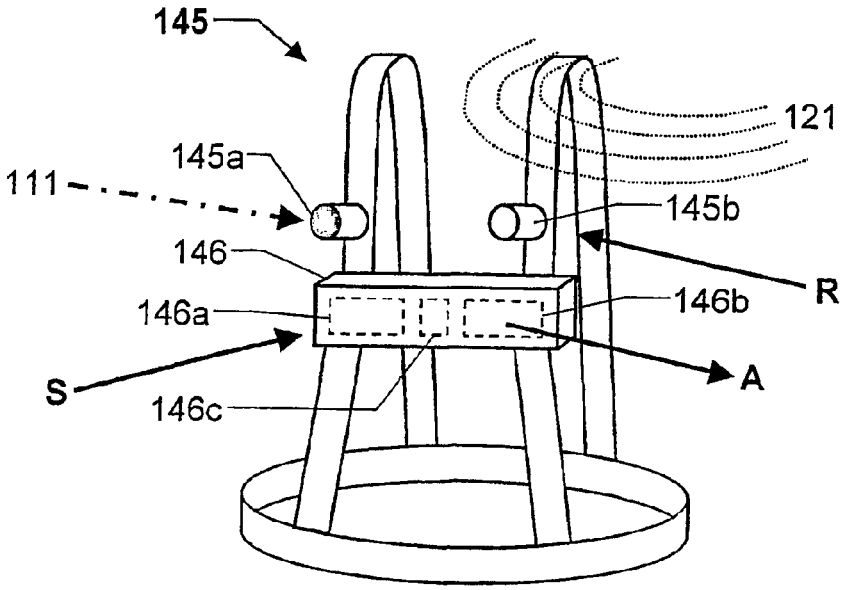
FIG. 1 shows a target object device for registering the effects caused by simulated fire against a target object according to an embodiment of the invention.
Figure 7:
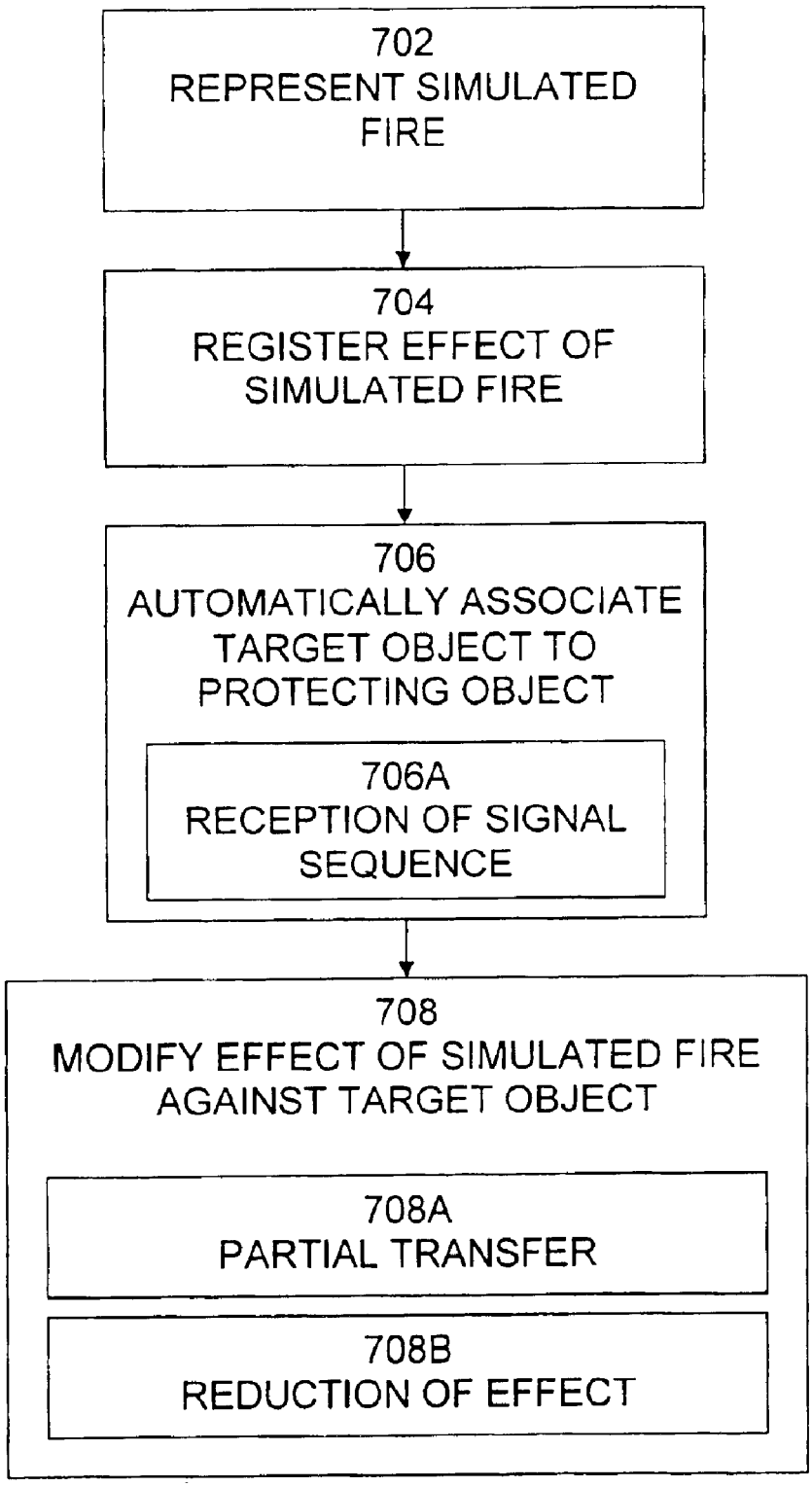
FIG. 7 illustrates, by means of a flow diagram, another aspect of a method according to the present invention.
Figure 8:
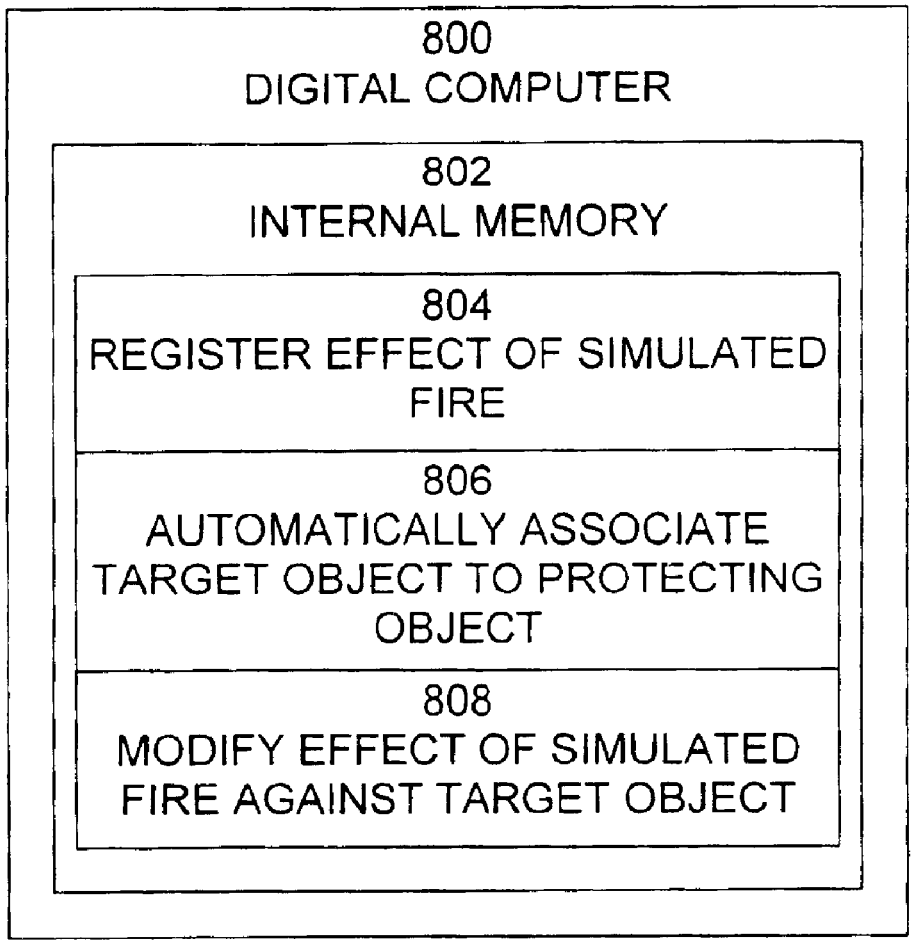
FIG. 8 illustrates an example of a digital computer that may be used to implement the present invention.

FIG. 1 shows a target object device 145 for registering effects caused by simulated direct fire and simulated indirect fire against a target object according to an embodiment of the invention. (see FIG. 7, step 704 and FIG. 8, block 804.) The target object device 145 is preferably designed as a waistcoat or a harness, since according to a preferred embodiment of the invention, the target object is a soldier. The target object device 145 may, however, be designed in any other way. This is particularly true in case the target object is different from a soldier. The device 145 includes at least a light sensor 145*a* for registering simulated fire, which is represented by light rays 111. Typically, direct fire is represented by light rays. In certain situations, for example when simulating shrapnel the indirect fire may at least partially be represented by light rays. (see FIG. 7, step 702.) The device 145 also includes at least one radio receiver 145*b* for registering simulated fire in the form of radio waves 121. It is primarily indirect fire that is represented by radio waves 121. Nevertheless, radio waves may also be utilized when simulating direct fire in the form of a directed explosive effect from for instance mines. The fact that a target object device 145 receives the radio waves 121, which represent the simulated fire does not necessarily imply that the target object device 145 is regarded as hit by the fire. According to a preferred embodiment of the invention, information conveyed via the radio waves 121 defines the effect of the fire. The effect of the fire is determined based on parameters such as distance and the characteristics of the fire with respect to the particular target object.

Moreover, the device 145 includes a first association means 146 for automatically associating the target object to a protecting object. (see FIG. 7, step 706 and FIG. 8, block 806) Such an association is effected when the target object is located at a position relative the protecting object, such that either the protecting object influences the effect of actual fire or when the protecting object influences the reception of the signals, which are used to simulate a live fire attack. (see FIG. 7, step 706A.) An example of this type of situation is when a soldier (target object) is located inside a building or a vehicle. Depending on the characteristics of the building/vehicle the protection against live fire may either be better or worse than what the signals that represent the fire indicate.

Figure 2:
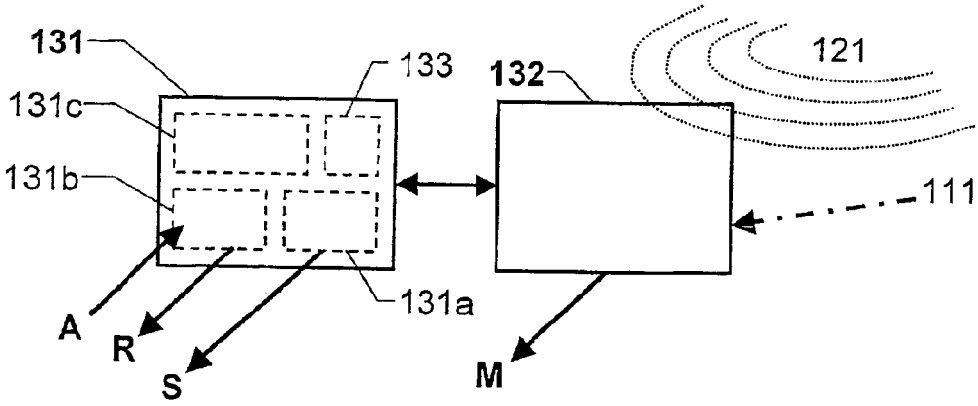
FIG. 2 shows a protecting object device according to an embodiment of the invention.

According to the invention, the protection provided by different kinds of protecting objects is modeled more realistically than what is given by the differences in transmission capability between actual fire and the signals that are used for the simulation. FIG. 2 shows a protecting object device according to an embodiment of the invention, which co-operates with a target object device 145 to accomplish a combat simulation with an improved realism. This is i.a. attained by the target object being informed of the protecting object and vice versa.

The protecting object device includes a second association means 131 for automatically associating a target object to a protecting object. It also includes a modifying means 132 for modifying the effects of the simulated fire against the target objects, which are associated to the protecting object. The modification of the simulated fire is performed with respect to the protecting object's capability to protect against the corresponding actual fire. Target objects are associated to the protecting object device by transmission of a signal sequence S from a transmitter 131*a* in the second association means 131. A presence detector 146*a* in a target object device 145 within range of the transmitted signal sequence S registers this signal. Furthermore, the target object device 145 receives a radio message R, which contains data related to the protecting object, such as its identity. The target object device 145 also transmits an association signal A via a transmitter 146*b* in response to the received signal sequence S and the transmitted radio message R, sent from a transceiver 131*b*.

In order to accomplish a relatively sharp delimitation of the range for the signal sequence S, according to a preferred embodiment of the invention, this signal is composed by a sequence of light pulses. The transmitter 131*a* thus includes a light source, such as a laser whose generated light lies in a wavelength range being adapted to the application in question. Arbitrary other signal format with similar characteristics may, of course, likewise be utilized. According to a preferred embodiment of the invention, the association signal A includes at least identifying information pertaining to the protecting object and the target object which is to be protected. Typically, this identifying information is composed by an equipment identity of the respective object. Preferably, the association signal A is a radio signal, since this signal format both has good transmission characteristics and the included identifying information determines its range, as opposed to the signal sequence S, and does therefore not require a delimitation in space. Consequently, for the same reason, the transmitter 146*b* preferably includes a radio transmitter and the second association means 131 includes a corresponding transceiver 131*b*, which is adapted to receive association signals A in the form that they are transmitted from the first association means 146. Additionally, the transceiver 131*b* includes a radio transmitter for transmitting radio messages R, which apart from denoting the protecting object's identity may define effects of simulated fire.

The modifying means 132 modifies the effects of simulated fire against target objects, (see FIG. 7, step 708 and FIG. 8, block 808.) which are associated to the protecting object in one out of four essentially different ways. The kind of modification performed is determined by the protecting object's nature with respect to the protection against the type of ammunition and fire being simulated.

A first kind of modification implies that all those target objects which are presently associated to the protecting object are protected completely from the incoming simulated fire. This modification is reasonable when the protecting object is a reinforced building or an armored vehicle and the simulated fire is indirect fire with a relatively minor effect, however the building/vehicle is pervious to the radio waves that simulate the fire. A second kind of modification implies that all those target objects which are presently associated to the "protecting" object are stroke out completely by the incoming fire. This kind of modification is reasonable when the protecting object is an unarmored vehicle and the simulated fire is direct fire, such as automatic fire with a relatively major effect, however the vehicle prevents the light rays that represent the fire from reaching the target object. A third kind of modification implies that target objects which are presently associated to the protecting object are stroke out according to a probability function based on the current simulated fire relative the protection that the protecting object provides against the corresponding actual fire. This modification may be reasonable when the consequences of the situation is comparatively uncertain, such as when an unarmored vehicle activates a troop mine. A fourth kind of modification implies that a light ray 111 or a radio signal 121, which has been received by the modifying means 132 is transmitted M in altered form and/or strength against those target objects which are associated to the protecting object in question.

Alternatively, the modifying means 132 may also transform an incoming signal of a first type into an outgoing signal M of a different type, such that for example, a received light ray generates an outgoing radio signal. A target object which is optically shielded, however unprotected against direct fire may thus be stroke out. Reverse, a received radio signal may naturally generate arbitrary outgoing light rays. Such a modification may be utilized to simulate shrapnel caused by the protecting object being damaged in an indirect fire attack and hence in turn risk damaging target objects associated thereto.

Generally, the modifying means 132 performs a modification M of the simulated fire such that the effect of simulated direct fire is at least partially transferred to an associated target object, which is located relative the protecting object 130*b* such that transmission of for example light rays is obstructed, however actual fire has effect. (see FIG. 7, step 708A.) Alternatively, the effect of simulated direct fire is reduced to an associated target object, which is located relative the protecting object such that transmission of light rays 111 is possible, however actual direct fire has a reduced effect. (see FIG. 7, step 708B.) Moreover, the effect of indirect fire is reduced to an associated target object, which is located relative the protecting object such that transmission of for example radio waves 121 is possible, however actual indirect fire has a reduced effect. Finally, the modification M may imply that the effect of simulated indirect fire is at least partially transferred to an associated target object, which is located relative a protecting object such that transmission of radio waves 121 is obstructed, however actual fire has effect.

In order to make certain that the target objects are only offered protection when they in fact also would have been protected against corresponding actual fire, both the first associating means 146 and the second associating means 131 include a timer 146*c* and 133 respectively, which cancel the association between the target object and the protecting object a specific time after that signals are no longer exchanged between them, i.e. signal sequences S and association signals A. Further details pertaining to this are disclosed below with reference to the FIGS. 6*a*–6*c*.

The second association means 131 in the protecting object device includes a register means 131*c* where information pertaining to identities of target objects, which presently are associated to the protecting object is stored. The protecting object device can thereby accomplish a modification of the effects of fire according to the proposed method. Furthermore, the protecting object device may, of course, define effects of simulated fire without regard to the content of the register means 131*c*. For example, the protecting object device may transmit (broadcast) a general message, which produces a strike-out of all receivers of the message.

Figure 3:
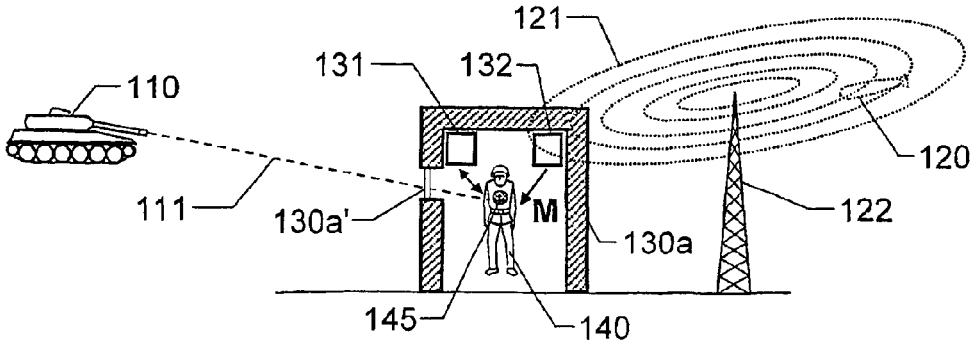
FIG. 3 illustrates a first example of a simulation application according to an embodiment of the invention.

A first example of an application according to an embodiment of the invention is shown in FIG. 3. A target object 140 in the form of a soldier is here presumed to be located in a relatively well protected space, such as a bomb-proof vault of armored concrete 130*a*. The target object 140 is provided with a target object device 145 for registering the effects of simulated fire against the target object 140. Simulated indirect fire in the form of a grenade 120, which explodes in proximity of the bomb-proof vault 130*a* is represented by radio waves 121 that are transmitted from a radio mast 122. The radio waves 121 reach a modifying means 132 inside the bomb-proof vault 130*a* and a modified signal M is generated according to what has been described above depending on the explosive power of the grenade 120, the distance between the explosion and the bomb-proof vault 130*a* and the bomb-proof vault's 130*a* resistance. According to a preferred embodiment of the invention, the grenade's explosive power and point of explosion are denoted by means of messages in the radio signal 121 while information stored in the modifying means 132 defines the bomb-proof vault's 130*a* resistance.

Simulated direct fire in the form of automatic fire from a firing system 110, such as a tank, is represented by a light ray 111, which passes through a light transparent surface 130*a*' in one of the bomb-proof vault's 130*a* walls and is presumed to hit the target object 140. Provided that the light transparent surface 130*a*' is constituted by armored glass this normally implies that the modifying means 132 modifies the effect of the simulated fire 111, such that the target object 140 is not regarded as having been hit by corresponding actual fire. If however, the light transparent surface 130*a*' as constituted by a less resistant material the modifying means 132 does normally not adjust the effect of the simulated fire, why the target object 140 hence is also regarded as having been hit by corresponding actual fire.

Figure 4:
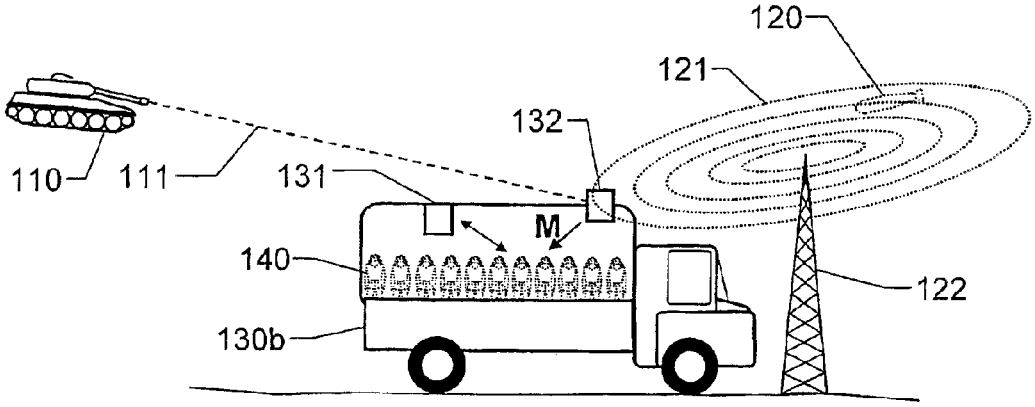
FIG. 4 illustrates a second example of a simulation application according to an embodiment of the invention.

FIG. 4 illustrates a second example of an application of an embodiment of the invention. A troop of soldiers constitute a target object 140 when they are traveling in an unarmored vehicle 130*b* in the form of a lorry. The target objects 140 are associated to the vehicle 130*b* as a protecting object via an association means 131. The lorry is covered with a tarpaulin. Hence, simulated fire in the form of light rays 111 from a firing system 110 does not reach the target objects' 140 target object devices. However, a modifying means 132 on the vehicle 130*b* registers the light ray 111 and transfers M the effect of the fire to the target objects 140 in the lorry. This either implies that all target objects 140 are stroke out or that the target objects are stroke out randomly according to a function based on for example the duration of the firing and the force of the ammunition. According to a preferred embodiment of the invention, the random operation is carried out locally for each target object device according to an algorithm whose parameters at least partly depend on data from the modifying means 132.

Simulated indirect fire in the form of for example a grenade 120, which explodes in proximity of the vehicle 130*b* causes radio waves 121 to be transmitted from a radio mast 122. The radio waves 121 probably reach the target objects' 140 target object devices. The modifying means 132 in the vehicle 130*b* however modifies M the received signal 121. If the grenade's explosive power is relatively low and the explosion is defined to be sufficiently remote, the vehicle 130*b* can be expected to provide a degree-of protection why the modification M preferably implies that the target objects 140 are stroke out according to a random function.

Figure 5:
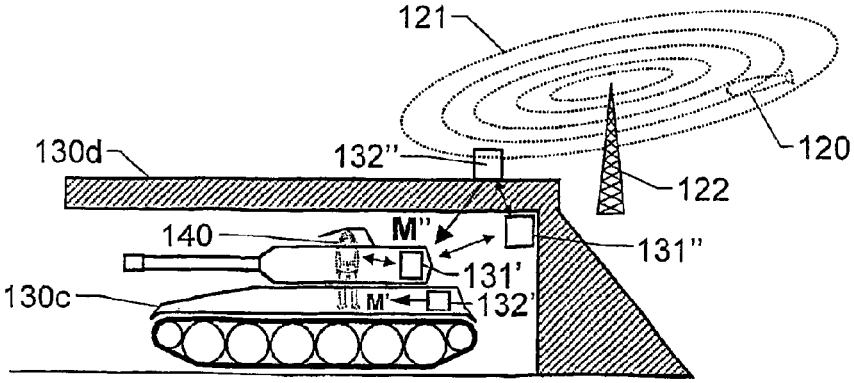
FIG. 5 illustrates a third example of a simulation application according to an embodiment of the invention.

FIG. 5 shows a third example of an application according to a an embodiment of the invention where it is made clear that modification of effects of simulated fire may occur stepwise from a first protecting object to a to a second protecting object. A soldier in a tank 130*c* constitutes a target object 140 and is associated to the tank 130*c* as a first protecting object via a primary association means 131'. The tank 130*c* is in turn regarded as a target object with respect to for example indirect fire in the form of grenades or bombs 120. The tank 130*c* is presumed to be positioned under cover from a defense 130*d* with a relatively high resistance against explosives and is thus associated to the defense 130*d* via a secondary association means 131".

When a simulated bomb 120 detonates in proximity to the defense 130*d* radio waves 121 are transmitted from a radio mast 122. Due to the defense's 130*d* solid walls however the radio waves 122 neither reach a receiver in the tank 130*c* nor a receiver at the soldier's target object device. If the simulated bomb 120 has a sufficiently strong explosive power it is nevertheless not excluded that a corresponding actual bomb would have an effect on the tank 130*c* and possibly the soldier 140. Therefore, a secondary modifying means 132" at the defense 130*d* transfers the effect of the simulated bomb 120 to the tank 130*c* via a secondary signal M". According to a preferred embodiment of the invention, this signal M" is constituted by radio waves, however the signal M" may equally well be constituted by light rays depending on what accomplishes the most realistic simulation in the specific case. A primary modifying means 132' in the tank 130*c* in turn transfers the reduced effect of the simulated bomb 120 to the target object 140 via a primary signal M'. This signal is in similarity with the signal M" preferably constituted by radio waves. However, light rays are not excluded.

Depending on the power of the simulated bomb 120 (being indicated in a message transferred by the radio waves 121), the distance (indicated by the message) between the defense 130*d* and the point of detonation for the bomb 120, the defense's 130*d* resistance and the tank's 130*c* resistance an effect of the detonation is simulated at the target object 140.

The above illustrated example of a modification in two steps of a simulated fire effect may naturally be generalized to include an arbitrary number of steps. In practice however, it is preferable if the number of steps can be kept as low as possible.

Figure 6A:
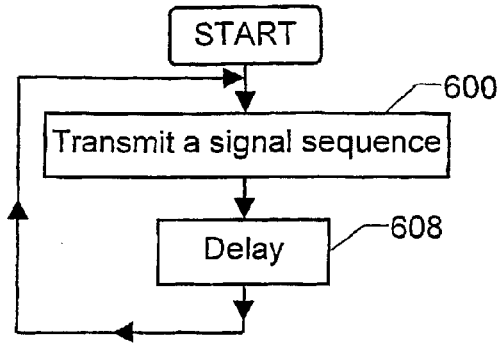
FIG. 6*a* illustrates, by means of a flow diagram, a first component of a first aspect of the method according to the invention.

A flow chart in FIG. 6*a* illustrates a first component of a first aspect of the method according to the invention, which is performed in a proposed protecting object device. In a first step 600, the protecting object device transmits a signal sequence, which denotes identifying information pertaining to the protecting object to which the protecting object device belongs. A following step 608 represents a delay. According to a preferred embodiment of the invention the delay varies to some extent, such that a degree of jitter is accomplished in the transmission of the signal sequences. After the step 608 the procedure is returned to the step 600.

Figure 6B:
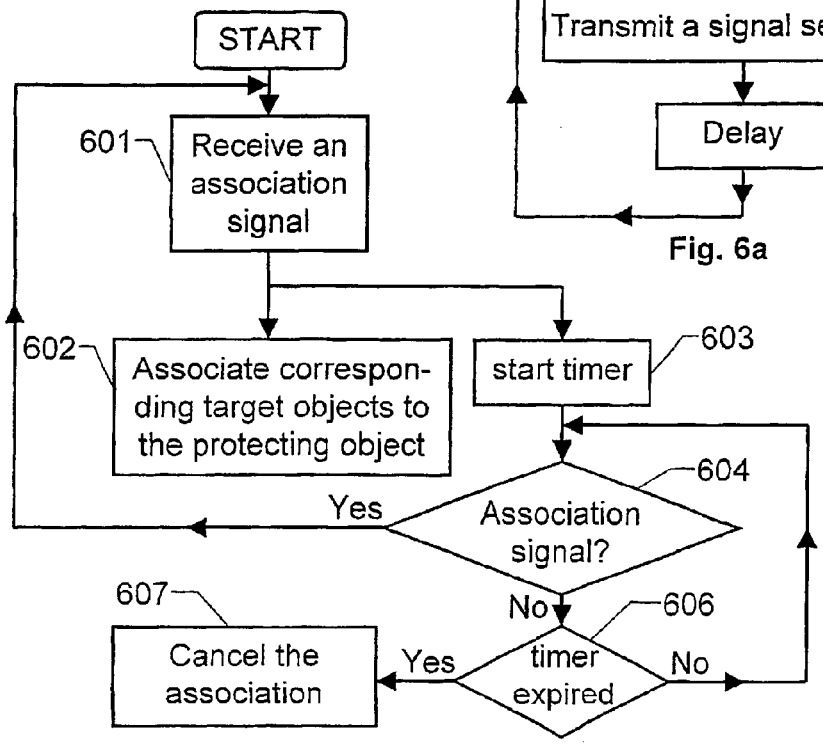
FIG. 6*b* illustrates, by means of a flow diagram, a second component of the first aspect of the method according to the invention.

A flow chart in FIG. 6*b* illustrates a second component of the first aspect of the method according to the invention, which is performed in the proposed protecting object device. In a first step 601, an association signal is presupposed to be received from one or more target objects in response to the signal sequence transmitted in the step 600. Thereafter, the procedure continues in parallel to a step 602 in which the target object in question is associated to the protecting object, and to a step 603 where a timer with a predetermined duration is started (reset). After the step 603, a step 604 investigates whether a renewed association signal has come in from the target object associated in step 602. If so, the procedure is returned to the step 601. Otherwise, a step 606 investigates whether the timer has expired. This is tested until either the timer expires or a renewed association signal comes in by the procedure being returned from the step 606 to the step 604 as long as the question posed in the step 606 is answered in the negative. If however, the timer expires without any association signal having been received the association is cancelled in a step 607.

According to a preferred embodiment of the invention, the timer's duration is chosen to such value that it corresponds to a longer time than the longest delay, which is generated in the step 608. This namely results in that the timer expires after a time period which exceeds the time interval between two consecutively transmitted signal sequences from the protecting object device. The association between the protecting object and the target object is hence not cancelled with a shorter notice than a longest distance in time between two consecutive signal sequences.

Figure 6C:
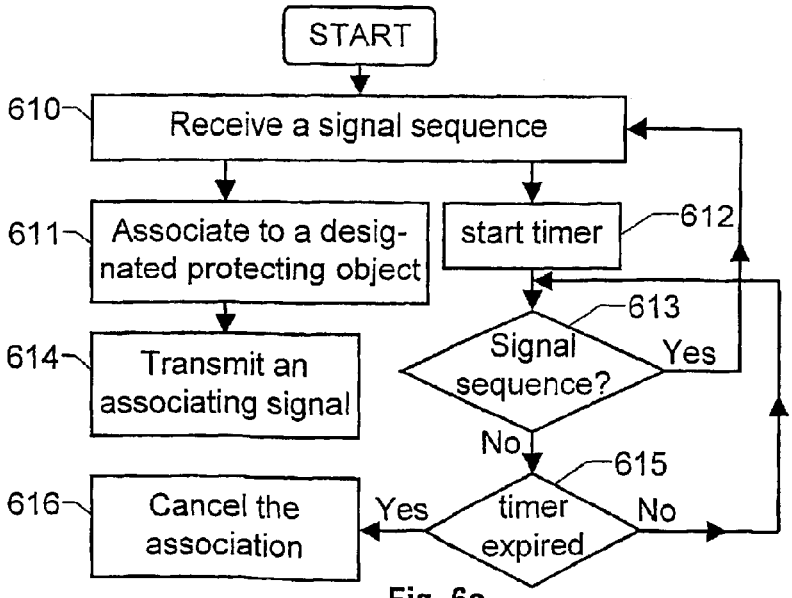
FIG. 6*c* illustrates, by means of a flow diagram, a second aspect of the method according to the invention.

FIG. 6*c* illustrates, by means of a flow chart, a second aspect of the method according to the invention, which is carried out in a proposed target object device. In a first step 610, the target object device is presupposed to receive a signal sequence, which denotes identifying information pertaining to a protecting object to which the target object device is offered a possibility to become associated. The procedure thereafter continues in two parallel steps. One step 611 registers an association to the protecting object and a step 612 starts (resets) a timer with a predetermined duration. After the step 611, the target object device transmits an association signal in response to the signal sequence received in a step 614. According to a preferred embodiment of the invention, the association signal includes identifying information pertaining to the protecting object. Moreover, it is advantageous if the association signal includes identifying information pertaining to the target object.

After the step 612, the procedure continues with a step 613, which investigates whether a new signal sequence has come in. If so, the procedure returns to the step 610 where after the timer is again started (reset). Otherwise, a step 615 tests whether the timer has expired. The procedure stops in a loop between the steps 613 and 615 until either a new signal sequence comes in or the timer expires. In the latter case, the association between the target object and the protecting object is cancelled in a step 616.

According to a preferred embodiment of the invention, the timer's duration is selected to such value that it corresponds to a longest expected time period between two consecutively transmitted signal sequences from the protecting object device. The association between the protecting object and target objects is thereby not cancelled with a shorter notice than the distance in time between two consecutive signal sequences.

All the process steps which have been described with reference to the FIGS. 6*a*–6*c* above may be controlled by means of a computer program, which is directly loadable into the internal memory of a computer and includes appropriate software for controlling the necessary steps when the program is run on the computer. (see FIG. 8, block 800 and 802.) The same is true for arbitrary sub-sequence of process steps. Naturally, the computer program may be stored on arbitrary storage medium.

The term "comprises/comprising" when used in this specification is taken to specify the presence of stated features, integers, steps or components. However, the term does not preclude the presence or addition of one or more additional features, integers, steps or components or groups thereof.

The invention is not restricted to the described embodiments in the figures, but may be varied freely within the scope of the following patent claims.

What is claimed is:

1. A method for simulating effects of direct fire and indirect fire against a target object comprising:

representing simulated fire by at least one of light rays and radio waves;

registering an effect of the simulated fire by at least one of a light sensor and a radio receiver co-located with the target object;

automatically associating the target object to at least one protecting object when the target object is located at a position relative to the protecting object such that the protecting object influences at least one of the effect of direct fire, the effect of indirect fire, reception of the light rays and reception of the radio waves, wherein the association is maintained via a local co-operation between the target object and the at least one protecting object respectively; and modifying the effects of the simulated fire against the target object with respect to the protecting object's capability to protect against corresponding actual fire.

2. A method according to claim 1, wherein the modifying comprises at least partial transfer of the effect of simulated direct fire to one target object which is associated with a protecting object that obstructs at least one of light rays and radio waves, however is pervious to actual direct fire.

3. A method according to claim 1, wherein the modifying comprises reduction of the effect of simulated direct fire to one target object which is associated with a protecting object that is pervious to at least one of light rays and radio waves, however reduces the effect of actual direct fire.

4. A method according to any claim 1, wherein the modifying comprises reduction of the effect of simulated indirect fire to one target object which is associated with a protecting object that is pervious to at least one of light rays and radio wave, however reduces the effect of actual indirect fire.

5. A method according to claim 1, wherein the modifying comprises at least partial transfer of the effect of simulated indirect fire to one target object which is associated with a protecting object that obstructs at least one of light rays and radio waves, however is pervious to actual indirect fire.

6. A method according to claim 1, wherein the associating of the target object to the protecting object comprises transmission of a signal sequence characterizing the protecting object, and reception of the signal sequence at the target object.

7. A method according to claim 6, wherein the signal sequence is transmitted repeatedly.

8. A method according to claim 7, comprising starting a first timer in the target object at reception of the signal sequence and ceasing the target object's association to the protecting object when the first timer expires.

9. A method according to claim 8, wherein the first timer expires after a total time period which exceeds a longest time interval between two consecutively transmitted signal sequences.

10. A method according to claim 6, comprising transmitting an association signal from the target object to the protecting object in response to a received signal sequence, the association signal including identifying information pertaining to the protecting object.

11. A method according to claim 10, wherein the association signal includes identifying information pertaining to the target object.

12. A method according to claim 11, comprising starting a second timer in the protecting object at reception of the association signal and ceasing the target object's association to the protecting object when the second timer expires.

13. A method according to claim 12, wherein the second timer expires after a total time period which exceeds a longest time interval between two consecutively transmitted signal sequences.

14. A computer program directly loadable into the internal memory of a digital computer, comprising software for performing when said program is run on a computer, the steps of:

representing simulated fire by at least one of light rays and radio waves;

registering an effect of the simulated fire by at least one of a light sensor and a radio receiver co-located with the target object;

automatically associating the target object to at least one protecting object when the target object is located at a position relative to the protecting object such that the protecting object influences at least one of the effect of direct fire, the effect of indirect fire, reception of the light rays and reception of the radio waves, wherein the association is maintained via a local co-operation between the target object and the at least one protecting object respectively; and modifying the effects of the simulated fire against the target object with respect to the protecting object's capability to protect against corresponding actual fire.

15. A computer readable medium, having a program recorded thereon, where the program is to make a computer perform the steps of:

representing simulated fire by at least one of light rays and radio waves;

registering an effect of the simulated fire by at least one of a light sensor and a radio receiver co-located with the target object;

automatically associating the target object to at least one protecting object when the target object is located at a position relative to the protecting object such that the protecting object influences at least one of the effect of direct fire, the effect of indirect fire, reception of the light rays and reception of the radio waves, wherein the association is maintained via a local co-operation between the target object and the at least one protecting object respectively; and modifying the effects of the simulated fire against the target object with respect to the protecting object's capability to protect against corresponding actual fire.

16. A target object device for registering effects at a target object caused by simulated direct fire and simulated indirect fire comprising at least one of:

a light sensor for registering simulated fire represented by light rays, and a radio receiver for registering simulated fire represented by radio waves, wherein the device comprises a first association means for automatically associating the target object to at least one protecting object when the target object is located at a position relative the protecting object such that the protecting object influences at least one of the effect of direct fire, the effect of indirect fire, reception of the light rays and reception of the radio waves, and means for locally maintaining the association to the at least one protecting object, means for locally maintaining the association adapted to co-operate with means in the at least one protecting object.

17. A target object device according to claim 16, wherein the first association means includes:

a presence sensor for receiving a signal sequence, and a transmitter for, in response to a received signal sequence, transmit an association signal including identifying information pertaining to the protecting object.

18. A target object device according to claim 17, wherein the association signal includes identifying information pertaining to the target object.

19. A target object device according to claim 17, wherein the presence sensor includes a light sensor and the signal sequence includes a sequence of light pulses.

20. A target object device according to claim 17, wherein the transmitter includes a radio transmitter and the association signal includes a radio signal.

21. A target object device according to claim 17, wherein the first association means includes a first timer, which is started at reception of a signal sequence from the protecting object and the target object's association to the protecting object ceases when the first timer expires.

22. A target object device according to claim 21, wherein the first timer expires after a time period which exceeds a longest interval between two consecutively transmitted signal sequences.

23. A protecting object device for automatic association of at least one target object to a protecting object and modification of effects caused by simulated direct fire and simulated indirect fire at the target object, wherein simulated fire is represented by at least one of light rays and radio waves, comprising a second association means for automatically associating a target object to a protecting object in response to an association signal from the target object, the second association means in turn including means for locally maintaining the association to the at least one associated target object, which means is adapted to co-operate with corresponding means in the at least one associated target object, and a modifying means for modifying the effects of the simulated fire against target objects, which are associated to the protecting object, with respect to the protecting object's capability to protect against corresponding actual fire.

24. A protecting object device according to claim 23, wherein the second association means includes a transmitter for transmitting signal sequences indicative of an identity of the protecting object to potential target objects, a receiver for receiving association signals from target objects, and a register means for storing information pertaining to identities of target objects which are associated to the protecting object and for which simulated effects of fire is to be modified.

25. A protecting object device according to claim 24, further comprising at least one second timer related to this target object which is started at reception of an association signal from the target object and the target object's association to the protecting object ceases when the second timer expires.

26. A protecting object device according to claim 25, wherein the second timer expires after a time period which exceeds a longest interval between two consecutively transmitted signal sequences.

27. A protecting object device according to claim 24, wherein the transmitter includes a light source which at least transmits signal sequences in the form of light pulses.

28. A protecting object device according to claim 24, wherein the receiver includes a radio receiver which at least is adapted to receive association signals in the form of radio signals.

29. A protecting object device according to claim 23, wherein the modifying means modifies the effects of the simulated fire, such that the effect of simulated direct fire is at least partially transferred to an associated target object, which is located relative the protecting object such that transmission of at least one of light rays and radio waves is obstructed, however actual direct fire has effect, the effect of simulated direct fire is reduced to an associated target object, which is located relative the protecting object such that transmission of at least one of light rays and radio waves is possible, however actual direct fire has reduced effect, the effect of simulated indirect fire is reduced to an associated target object, which is located relative the protecting object such that transmission of at least one of light rays and radio waves is possible, however actual indirect fire has reduced effect, and the effect of simulated indirect fire is at least partially transferred to an associated target object, which is located relative the protecting object such that transmission of at least one of light rays and radio waves is obstructed, however actual indirect fire has effect.

30. A combat simulating system for simulating effects of direct fire and indirect fire against target objects, wherein simulated fire is represented by at least one of light rays and radio waves and the effect of the fire is registered by at least one of a light sensor being co-located with respective target object and a radio receiver being co-located with respective target object, wherein it comprises at least one target object which is assigned a target object device comprising at least one of:

a light sensor for registering simulated fire represented by light rays, and a radio receiver for registering simulated fire represented by radio waves;

wherein the device comprises a first association means for automatically associating the target object to at least one protecting object when the target object is located at a position relative the protecting object such that the protecting object influences at least one of the effect of direct fire, the effect of indirect fire, reception of the light rays and reception of the radio waves, and means for locally maintaining the association to the at least one protecting object, the means for locally maintaining the association adapted to co-operate with means in the at least one protecting object.

* * * * *